US012193554B2

(12) United States Patent
Zheng et al.

(10) Patent No.: US 12,193,554 B2
(45) Date of Patent: Jan. 14, 2025

(54) APPLICATOR HEAD FOR APPLYING A COSMETIC PRODUCT

(71) Applicant: APR Beauty Group, Inc., Toronto (CA)

(72) Inventors: Min-Yan Zheng, Richmond Hill (CA); Feng-Ying Fu, Markham (CA); Jun Shen, Lighthouse Point, FL (US)

(73) Assignee: APR Beauty Group Inc., Toronto (CA)

( * ) Notice: Subject to any disclaimer, the term of this patent is extended or adjusted under 35 U.S.C. 154(b) by 351 days.

(21) Appl. No.: 17/868,411

(22) Filed: Jul. 19, 2022

(65) Prior Publication Data

US 2024/0023694 A1 Jan. 25, 2024

(51) Int. Cl.
*A45D 34/04* (2006.01)

(52) U.S. Cl.
CPC ..... *A45D 34/04* (2013.01)

(58) Field of Classification Search
CPC .... A45D 40/26; A45D 40/261; A45D 40/267; A45D 40/28; A45D 2200/10; A45D 2200/1018; A45D 34/04
See application file for complete search history.

(56) References Cited

U.S. PATENT DOCUMENTS 9,788,636 B2 10/2017 von Jan et al.
2015/0272298 A1* 10/2015 von Jan ..... A45D 40/265 401/119
2016/0081455 A1* 3/2016 Shen ..... A45D 40/26 604/289

* cited by examiner

*Primary Examiner* — Rachel R Steitz
(74) *Attorney, Agent, or Firm* — Jason L DeFrancesco

(57) ABSTRACT

An applicator head for applying a product including a cosmetic, care, or pharmaceutical product onto the keratinous substrate. The applicator head includes an applying member elongated along a longitudinal axis. The applying member includes at least one sidewall and a distal end face that is inclined. The at least one sidewall has an extended portion that extends beyond the distal end face of the applying member. The extended portion peripherally encloses the distal end face to define a cavity at the distal end portion of the applying member. The cavity opens upwardly at a distal end of the applying member and has a closed bottom end that is defined by the distal end face of the applying member. The cavity is suitable for holding a cosmetic product. The extended portion is in form of multiple petals that surround the distal end face.

20 Claims, 5 Drawing Sheets

APPLICATOR HEAD FOR APPLYING A COSMETIC PRODUCT

BACKGROUND

Field of the Invention

The present disclosure generally relates to an applicator head for applying a fluid product, such as cosmetic product, care, or pharmaceutical products onto a keratinous surface such as lips, skin, under-eye, and cheeks, particularly lips.

Description of the Related Art

Cosmetic applicators such as dip or wand applicators are known in the cosmetic industry. Cosmetic packages often include such applicators for dispensing a particular cosmetic contained in the package reservoir. The cosmetic applicator generally includes a stem with a cap at one end and an applicator head in the form of a brush, spatula, or other applicator structure suitable for applying a cosmetic or a care product including viscous cosmetics, lip gloss, lip color, wound care, under-eye cosmetics, pharmaceutical and like products.

The conventional applicators have to be dipped into a cosmetic product several times in a repeated manner to complete the entire application process. Thus, an applicator capable of holding a considerable amount of cosmetic liquid is required.

U.S. Pat. No. 9,788,636B2 discloses an applicator with an internal passive reservoir and an applicator body having a plurality of wings that distally each have a freely projecting end and form a mass storage space. The wings extend obliquely outwards relative to the longitudinal applicator axis and all wings extend obliquely outwards in different directions and wings are curved concavely outwards.

There is still a need for an applicator with an applicator head that not only has a cavity for storing a cosmetic product but has surfaces that are suitable for applying, distributing, and massaging a cosmetic product on a keratinous surface.

SUMMARY

It is an object of the present disclosure to provide a cosmetic package that can be easily configured to contain a cosmetic product and an applicator head.

It is an object of the present disclosure to provide an applicator head that can apply a cosmetic product, care, pharmaceuticals, or like products onto a keratinous surface such as lips, skin, under-eye, and cheeks, particularly lips. Further, the product can be a liquid, viscous or semi-solid product.

It is a further object to provide an applicator head that can apply a larger amount of cosmetic product without the need to re-dipping the applicator into the cosmetics supply occasionally. The applicator head provides faces that are suitable for applying, distributing, and massaging a cosmetic product on a keratinous surface.

It is yet another object of the present disclosure to provide an applicator head that offers a comparatively large surface area, very simple to use, economical to manufacture, and aesthetically pleasing.

Accordingly, there is provided an applicator head according to a preferred embodiment of the present disclosure. The applicator head comprises an applying member at its distal portion and a shank member at its proximal portion. The applying member of the applicator head is configured to apply the product including a cosmetic or care product. The applying member includes a distal end face and at least one sidewall extending from the proximal end of the applying member to a distal end of the applying member. The applying member includes a columnar body that extends from the proximal end towards the distal end of the applying member. The applying member includes at least one sidewall and a distal end face. The at least one sidewall of the applying member further includes an extended portion that extends beyond the distal end face of the applying member and defines the distal end of the applying member.

According to an aspect of the present disclosure, the extended portion of the at least one sidewall peripherally encloses the distal end face of the applying member to define a cavity at the distal end portion of the applying member. The cavity opens upwardly at the distal end of the applying member and has a closed bottom end that is defined by the distal end face of the applying member. The extended portion comprises multiple petals that surround the distal end face. The extended portion has multiple grooves on its outer surface facing the cavity. Each groove substantially extends along a length direction of the petal. The grooves extend between the adjacent petals and define at least one common lateral edge between the adjacent petals. The grooves are made in the thickness of the extended portion without causing any fragmentation in the extended portion. The grooves thus divide the extended part into several portions that form petals.

According to an aspect of the present disclosure, the distal end face makes a non-zero angle with the longitudinal axis of the applicator head. Preferably, the distal end face makes an acute angle with the longitudinal axis of the applying member. Preferably, this acute angle is in the range between 30° and 75. The distal end face extends along at least 20% of the length of the applying member and at most 40% of the length of the applying member. The distal end face is inclined towards the front face.

Further, the extended portion of the at least one sidewall can include two or more petals, though some embodiments of the extended portion of the at least one sidewall include eight or more petals, or the like. The petals may have the same or different petal thickness, petal geometry, height, and presence or absence of grooves or dimples. In a preferred embodiment, at least two petals have different widths and shapes. Each petal is laterally joined to the adjacent petals such that there are no circumferential gaps or slots between the adjacent petals. Further, each petal has lateral edges that are common to the adjacent petals. A groove is defined at the lateral edges that are common to the adjacent petals.

The at least one sidewall defines a front face, a rear face, a left face, and a right face of the applying member.

According to another aspect of the present disclosure, the left face and the right face are symmetrical relative to a plane of symmetry comprising the longitudinal axis of the applying member.

According to yet another aspect of the present disclosure, each of the petals has a length that forms at most about one-fourth of the total length of the applying member. At least a few grooves of the extended portion near the distal end of the extended portion extend further onto an upper edge of the extended portion and then onto the rear face of the applying member. The grooves that extend on the rear face converge and meet at a point on the rear face. The point on the rear face where the grooves meet is located at least half the length of the applying member.

According to yet another aspect of the present disclosure, the distal portion of the rear face, where the grooves extend, is convexly curved both in width and length direction thereof. Because of the presence of the grooves on the distal portion of the rear face, the rear face forms finger-like protruded surfaces. The distal portion of the rear face is suitable for applying or massaging the cosmetic applied on the keratinous surface.

In some other embodiments of the present disclosure, the grooves can have any shapes or profiles. For example, grooves may be rounded or v-shaped. Other shapes are possible and are contemplated.

According to an aspect of the present disclosure, the outer surface of the petals may be smooth or textured.

According to yet another aspect of the present disclosure, the upper edges of some of the petals may define at least one apex. At least one apex may or may not be off-centered from a central longitudinal axis of the respective petal.

According to yet another aspect of the present disclosure, the applying member comprises eight petals at the distal portion of the applying member and the petals surround the cavity at the distal end portion of the applying member. At least one of the eight petals, a distal-most petal, is located at the distal-most portion of the applying member. The distal-most portion has an apex that defines the distal end of the applying member. More particularly, the distal-most petal is arranged at an upper peripheral edge of the distal end face. Another of the eight petals, a proximal-most petal, is located at a lower peripheral edge of the distal end face.

According to yet another aspect of the present disclosure, the plane of symmetry of the applying member passes through the centers of the distal-most petal and the proximal-most petal. There are three petals arranged at a peripheral right edge of the distal end face between the distal-most petal and the proximal-most petal. Similarly, three petals are located along a peripheral left edge of the distal end face arranged between the distal-most petal and the proximal-most petal.

According to an aspect of a preferred embodiment, at least two petals have the same shape and at least two petals have shapes different from each other. The petals may have shapes that are hexagonal, pentagonal, triangular, rectangular, or any other suitable shape. In other words, at least two petals differ in their dimensions such as length, width, thickness, shape, and curvature.

According to an aspect of a preferred embodiment, at least one of the petals has a maximum width between 3.5-7 mm. At least one other petal has a maximum width between 1.5-2.5 mm. The length of the petals may range between 0.5-3 mm. The thickness of the petals may range from 0.5-1.5 mm.

According to another aspect of a preferred embodiment, the proximal-most petal is widest of the all the petals. The proximal-most petal has a lip-like structure with two apexes.

According to another aspect of a preferred embodiment, the distal-most petal is the longest of all the petals.

In a preferred embodiment, at least one sidewall of the applying member has rounded cross-sections that are substantially circular along a major length of the applying member. The term "substantially circular" is used herein to describe the circular or nearly circular shape. The transverse cross-section of a lower portion of the applying member is circular along the length direction. More particularly, applying member has substantially circular transverse cross-sections when seen towards proximal to the distal end till the point where the grooves meet at the rear face.

According to an aspect of a preferred embodiment, when at least one sidewall of the applying member is viewed from the proximal end towards the distal end of the applying member, the at least one sidewall has a convex portion followed by a concave portion.

According to an aspect of the present disclosure, the maximum width of the applying member is between 5-8 mm. The minimum width of the applying member is between 3-6 mm.

According to an aspect of the present disclosure, the cavity at the distal end portion of the applying member is suitable for holding a cosmetic bulk for applying it on a keratinous surface. The cavity has a varying depth that ranges between 0.5 mm-1.5 mm, more particularly between 0.8 mm-1.0 mm.

According to an aspect of the present disclosure, the distal end face defines a closed bottom end for the cavity of the applying member, and the upper edge of the extended portion of the at least one sidewall defines an upper opening of the cavity. The distal end face has a consistently continuous convex curve along a width direction, i.e. the distal end face is not flat, but instead protrudes outward in a convex fashion.

The upper edge 89 of the extended portion 81*a* is a continuous surface extending in a circumferential direction and is inclined with respect to a longitudinal axis of the applying member 8; and the upper edge 89 of the extended portion 81*a* undulates in an irregular manner.

The front face has a height less than the height of the rear face. The height of the front face is at least 60% of the height of the rear face of the applying member.

According to an aspect of the present disclosure, an outer surface of the applying member may be flocked with fibers. Briefly, the fibers for flocking which may be of any commonly used material, such as nylon, polyester, or any natural fiber are applied with an adhesive, such as an epoxy, to the surface to be flocked. The flocking finish to the outer surface of the applying member may be achieved by an appropriately chosen known technique, such as electrostatic flocking.

According to an alternate embodiment of the present disclosure, the applying member may or may not be flocked or partially flocked.

According to yet another aspect of the present disclosure, there is provided a cosmetic package comprising a receptacle for holding a cosmetic product and a cosmetic applicator. The cosmetic applicator comprises the applicator head according to present disclosure, a stem, and a cap. The cap of the cosmetic applicator has threads that can be screwed onto threads, formed on a neck of the receptacle. The applicator head is retained at a distal end of the stem for applying the product; and the cap at a proximal end of the stem.

In general, the use of the terms "distal" and "proximal" herein is supposed to mean that the distal is the end facing towards the inside of the storage receptacle, whereas the proximal is the end facing towards the removal opening of the receptacle.

The applicator head and the applying member are elongated along a central longitudinal axis X of the cosmetic applicator. The applying member has a distal end and a proximal end that are opposite relative to the longitudinal axis and are separated, along said axis, by a distance. Wherein, said distance is, for example, between 12 mm and 20 mm, and preferably between 13 mm, or 16 mm.

According to yet another aspect of the present disclosure, the distal end of the stem includes an interior longitudinal cavity for receiving and retaining the applicator head. Inserted in the neck of the receptacle is a wiper for wiping off excess product from the cosmetic applicator.

Further, the applicator head of the cosmetic applicator may be used to apply the product including a cosmetic or care product. The cosmetic or care product includes viscous cosmetics, mascara, eyebrow powder, lip gloss, hair color, skincare, under-eye cosmetics, pharmaceutical, and like products.

In a preferred embodiment, the shank member and the applying member are integral, however in alternate embodiments that may be two separate parts. The applying member is designed to apply the product to a target surface.

According to an aspect of the present disclosure, the shank member of the applicator head may be secured to the stem, for example, a press-fit, snap-fit, adhesive, and/or engagement by one or more engagement features.

According to an embodiment of the present disclosure, at least a part of the applicator head can be made by molding, e.g. by injection-molding, e.g. in a material selected from the following list: thermoplastic materials; elastomers; thermoplastic elastomers; thermoplastic elastomer polyester such as HYTREL®, for example; nitrile rubber; silicone rubber; ethylene-propylene terpolymer rubber (EPDM); styrene-ethylene-butylene-styrene (SEBS); styrene-isoprene-styrene (SIS); polyurethane (PU); ethyl vinyl acetate (EVA); polyvinyl chloride (PVC); polyethylene (PE); polyethylene terephthalate (PET); polypropylene (PP); this list not being limiting.

In the first embodiment, the wiper serves to wipe off not only the excess cosmetic product attached to the applying member but also the cosmetic product attached to the stem.

According to a preferred embodiment, the receptacle and the cap may be made of a rigid material like glass, metal, hard plastic, or any other material known in the art. However, in alternate embodiments, the receptacle and the cap may be made of a flexible material like flexible polymeric material or any other material known in the art.

According to an aspect of the present disclosure, the stem presents a circular cross-section, but it is not beyond the ambit of the present disclosure for this to be otherwise, in particular when the cross-section of the stem is oval, elliptical, or polygonal, e.g. square, triangular or rectangular. The stem can be solid as shown, or, in a variant, it could be hollow.

When the stem is not of circular cross-section, the cap can be fastened on the receptacle by snap-fastening or by some other means, without turning relative to said receptacle. The wiper can thus present a non-circular wiper orifice of the section that is complementary to the section of the stem.

According to an embodiment of the present disclosure, the applicator head can be made, at least in part, from a material that is more flexible than the material from which the stem is made.

According to the present disclosure, the stem can have a longitudinal axis that is rectilinear as shown. However, in alternate embodiments, it could be curved.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein.

DETAILED DESCRIPTION

Figure 1:
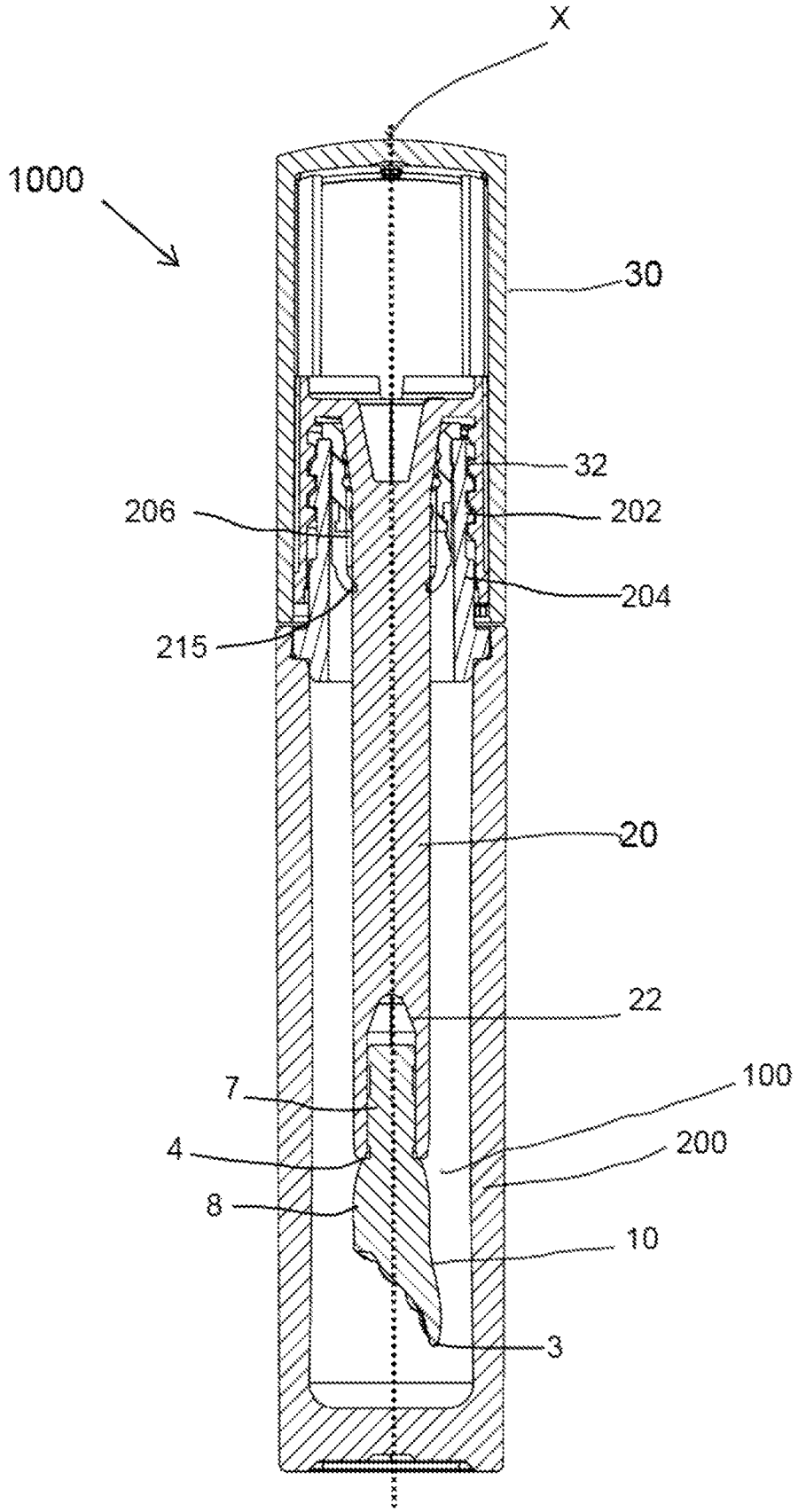
FIG. 1 illustrates a longitudinal cross-sectional view of a cosmetic package equipped with a cosmetic applicator according to a first embodiment of the present disclosure.

As shown throughout the drawings, like reference numerals designate like or corresponding parts. While illustrative embodiments of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered limited by the foregoing description.

Throughout this specification, the terms "comprise," "comprises," "comprising" and the like, shall consistently mean that a collection of objects is not limited to those objects specifically recited.

Figure 2:
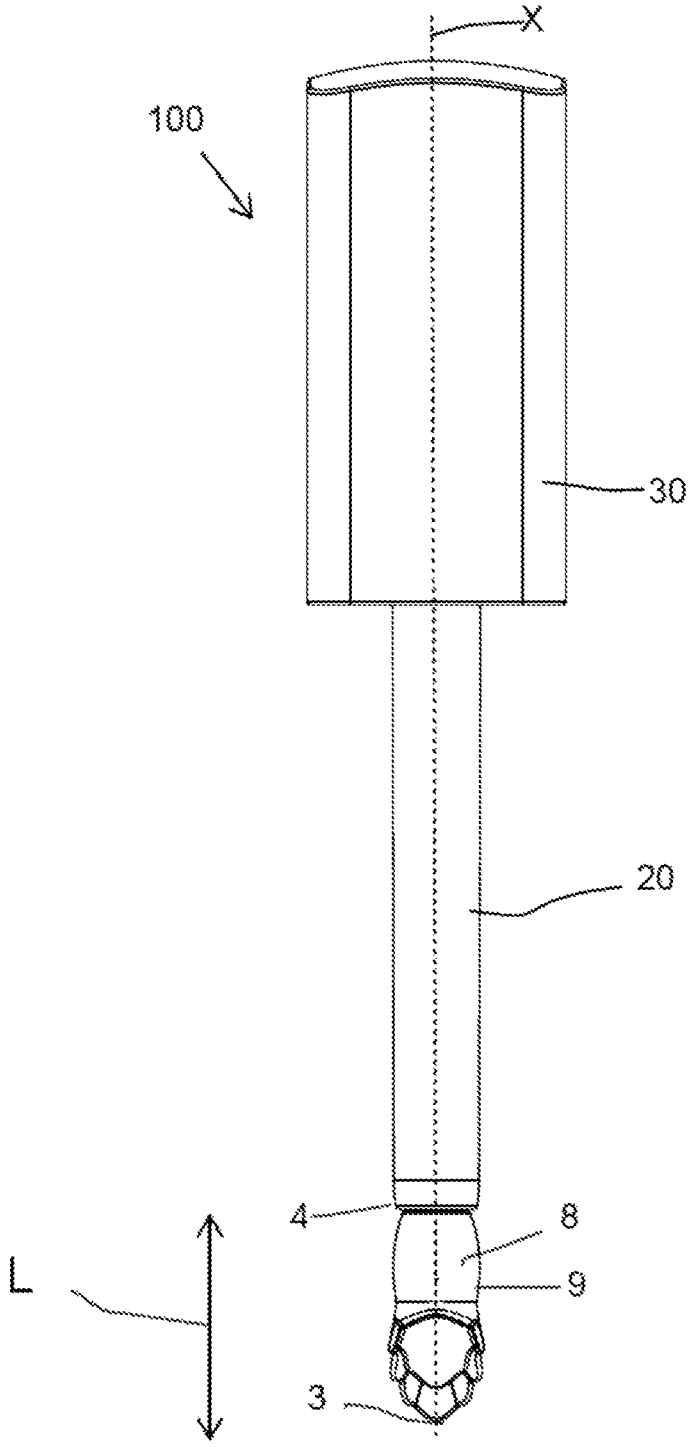
FIG. 2 illustrates a front view of the cosmetic applicator of the cosmetic package of FIG. 1.

FIG. 1 illustrates a longitudinal sectional view of a cosmetic package 1000. The cosmetic package 1000 comprises a receptacle 200 for holding a product (not shown) and a cosmetic applicator 100. The cosmetic applicator 100 comprises an applicator head 10, a stem 20, and a cap 30, see FIGS. 1 & 2. The cap 30 of the cosmetic applicator 100 has threads 32 that can be screwed onto threads 202, formed on a neck 204 of the receptacle 200. The applicator head 10 is retained at a distal end of the stem 20 for applying the product; and the cap 30 at a proximal end of the stem 20.

In general, the use of the terms "distal" and "proximal" herein is supposed to mean that the distal is the end facing towards the inside of the storage receptacle 200, whereas the proximal is the end facing towards the removal opening of the receptacle 200.

As seen in FIG. 1, the distal end of the stem 20 includes an interior longitudinal cavity 22 for receiving and retaining the applicator head 10. Inserted in the neck 204 of the receptacle 200 is a wiper 206 for wiping off excess product from the cosmetic applicator 100.

Further, the applicator head 10 of cosmetic applicator 100 may be used to apply the product including a cosmetic or care product. The cosmetic or care product includes viscous cosmetics, mascara, eyebrow powder, lip gloss, hair color, skincare, under-eye cosmetics, pharmaceutical, and like products.

Figure 3:
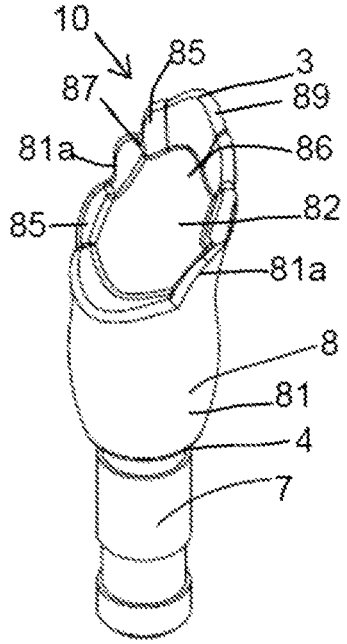
FIG. 3 illustrates a perspective view of an applicator head of the cosmetic applicator of FIG. 2.
Figure 4:
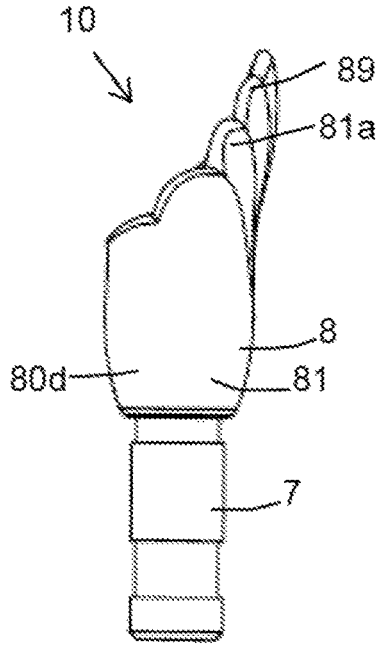
FIG. 4 illustrates a right side view of the applicator head of FIG. 3.
Figure 5:
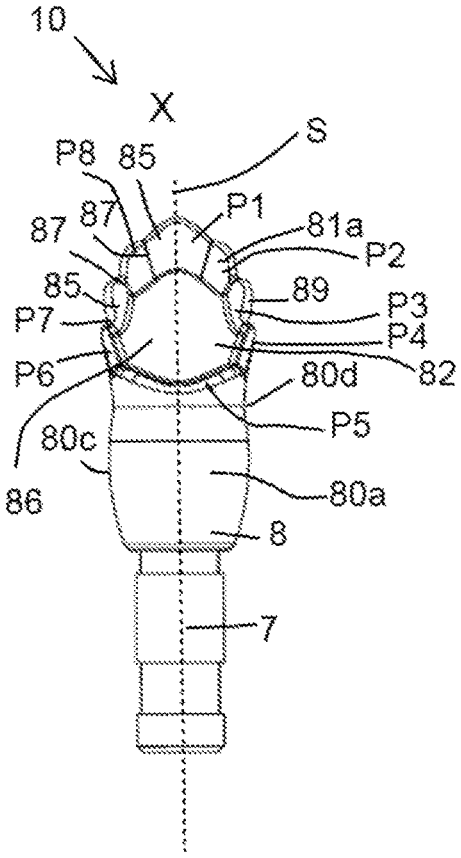
FIG. 5 illustrates a front view of the applicator head of FIG. 3.

As shown in FIGS. 3-5, the applicator head 10 comprises an applying member 8 at its distal portion and a shank member 7 at its proximal portion. The shank member 7 is configured to be received and retained within the longitudinal cavity 22 of the stem 20 (see FIG. 1).

In the present embodiment, the shank member 7 and the applying member 8 are integral, however in alternate embodiments that may be two separate parts. The applying member 8 is designed to apply the product to a target surface.

The applicator head 10 and the applying member 8 are elongated along a central longitudinal axis X of the cosmetic applicator 100 (refer to FIG. 1). The applying member 8 has a distal end 3 and a proximal end 4 that are opposite relative to the axis X and are separated, along said axis X, by a distance marked L in FIG. 2. Wherein, said distance L is, for example, between 12 mm and 20 mm, and preferably between 13 mm, or 16 mm. The distance L is the length of the applying member 8.

Figure 6:
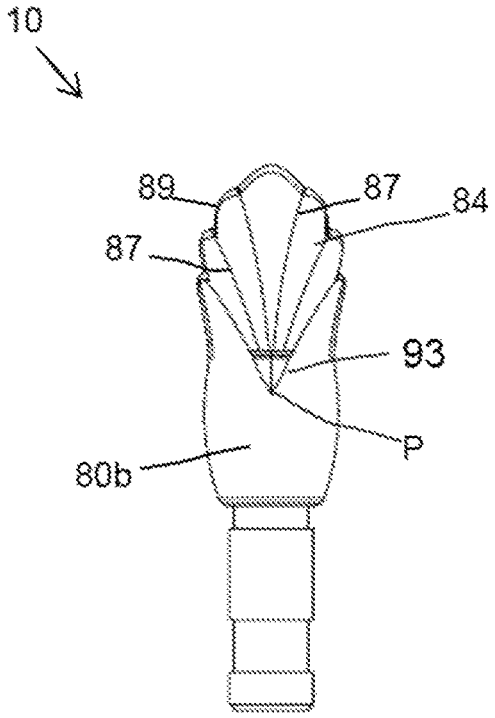
FIG. 6 illustrates a back view of the applicator head of FIG. 3.

Referring to FIGS. 5-6 the applying member 8 includes a columnar body that extends from the proximal end 4 towards the distal end 3 of the applying member 8. As illustrated in FIGS. 5, the applying member 8 includes at least one sidewall 81 and a distal end face 82. The at least one sidewall defines a front face 80*a*, a rear face 80*b*, a left face 80*c*, and a right face 80*d* of the applying member 8, refer FIGS. 3-6. The at least one sidewall 81 includes an extended portion 81*a* that extends beyond the distal end face 82 of the applying member 8 and defines the distal end 3, refer FIG. 3. The extended portion 81*a* of the at least one sidewall 81 peripherally encloses the distal end face 82 of the applying member 8 and defines a cavity 86 with the distal end face 82 that opens upwardly. The extended portion 81*a* of the at least one sidewall 81 is in the shape of a flower with multiple petals 85 that surround the distal end face 82.

Referring to FIG. 3, the extended portion 81*a* of the at least one sidewall 81 as disclosed herein can include two or more petals 85, though some embodiments of the extended portion 81*a* of the at least one sidewall 81 include eight or more petals 85, or the like. The petals 85 may have the same or different petal thickness, petal geometry, petal length, height, and presence or absence of grooves or dimples. In the present embodiment at least two petals 85 have different widths and shapes. Each petal 85 is laterally joined to the adjacent petals 85 such that there are no circumferential gaps or slots between the adjacent petals 85, i.e. petals 85 are joined along laterally adjacent edges.

Further, each petal 85 has lateral edges that are common to the adjacent petals 85. A groove 87 is defined at the lateral edges that are common to the adjacent petals 85, see FIG. 5.

Figure 9:
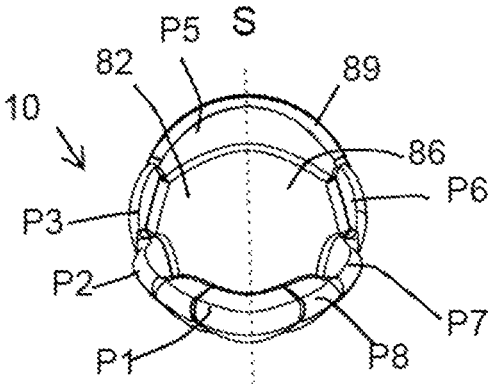
FIG. 9 illustrates a top view of the applicator head of FIG. 3.

Referring to FIGS. 3, 5 and 9, the extended portion 81*a* thus includes multiple grooves 87 on its outer surface facing the cavity 86. Each groove 87 substantially extends along a length direction of the petal 85. The grooves 87 extend between the adjacent petals 85 and define at least one common lateral edge between the adjacent petals 85. The grooves 87 thus divide the extended part 81*a* into several portions that form petals 85. The grooves 87 are made in the thickness of the extended portion 81*a* without causing any fragmentation in the extended portion 81*a*.

At least a few grooves 87 of the extended portion 81*a* near the distal end of the extended portion 81*a* extend further up to an upper edge 89 and then onto the rear face 80*b* of the applying member 8. The grooves 87 that extend on rear face 80*b* converge and meet at a point P on the rear face 80*b*, refer FIG. 6. The point P on the rear face 80*b* where the grooves 87 meet is located at least half a length of the applying member 8.

Referring to FIG. 6, the distal portion of the rear face 80*b*, where the grooves 87 extend, is convexly curved both in width and length direction thereof. Because of the presence of the grooves 87 on the distal portion of the rear face 80*b*, the rear face 80*b* forms a plurality of finger-like protruded surfaces. The distal portion of the rear face 80*b* is suitable for applying or massaging the cosmetic applied on the keratinous surface.

In some other embodiments, the grooves 87 can have any shapes or profiles. For example, grooves 87 may be rounded or v-shaped. Other shapes are possible and are contemplated.

According to an aspect of the present disclosure, the outer surface of the petals 85 may be smooth or textured.

An upper edge of some of the petals 85 may define at least one apex. The at least one apex may or may not be off-centered from a central longitudinal axis of the respective petal 85.

As seen in FIG. 5, the applying member 8 comprises eight petals, P1, P2, P3, P4, P5, P6, P7, and P8 at the distal portion thereof surrounding the cavity 86 at the distal end portion of the applying member 8. At least one of the eight petals, a distal-most petal P1, is located at the distal-most portion of the applying member 8 and has an apex that defines the distal end of the applying member 8. More particularly, the distal-most petal P1 is arranged at an upper peripheral edge of the distal end face 82. Another of the eight petals, a proximal-most petal P5, is located at a lower peripheral edge of the distal end face 82. The plane of symmetry S of the applying member 8 passes through the centers of the distal-most petal P1 and the proximal-most petal P5. There are three petals P2, P3, and P4 arranged at a peripheral right edge of the distal end face 82 between the distal-most petal and the proximal-most petal, and three petals P6, P7, and P8 are located along a peripheral left edge of the distal end face 82 arranged between the distal-most petal P1 and the proximal-most petal P2.

According to an aspect of the present embodiment, at least two petals 85 have the same shape and at least two petals 85 have shapes different from each other. The petals may have shapes that are hexagonal, pentagonal, triangular, rectangular, or any other suitable shape. In other words, at least two petals 85 differ in their dimensions such as length, width, thickness, shape, and curvature.

At least one of the petals P1 and P5 has a maximum width between 3.5-7 mm. At least one other petal P2, P3, P4, P6, P7, and P8 has a maximum width between 1.5-2.5 mm. The length of the petals 85 may range between 0.5-3 mm. The thickness of the petals 85 may range from 0.5-1.5 mm.

As seen in FIG. 5, the proximal-most petal P5 is widest of the all the petals 85. The distal-most petal P1 is the longest of all the petals 85. The proximal-most petal P5 has a lip-like structure with two apexes.

Each of the petals 85 has a length that forms at most about one-fourth of the total length of the applying member 8. Further, the surface area of the distal end face 82 is larger than the surface area of each of the petals 85. The distal end face 82 extends along a Z axis that makes a non-zero angle b with the central longitudinal axis and angle b is in the range between 30° and 75°, see FIG. 8. The length of the distal end face 82 measured along the Z axis is at least three times the length of each of the petals 85. The length of distal end face 82 is between 5-8 mm and the width of the distal end face 82, measured perpendicularly to the longitudinal axis Z of the distal end face 82, is between 4-6 mm. Thus, the distal end face 82 is easily accessible and provides a larger surface area that is able to contact a keratinous surface of a user.

The distal end face 82 extends along at least 20% of the length of the applying member and at most 40% of the length of the applying member 8. The distal end face 82 is inclined towards the front face 80*a*.

Further, as seen in FIGS. 3-5, the upper edge 89 of the extended portion 81*a* is a continuous surface in a circumferential direction and is inclined with respect to a longitudinal axis X of the applying member 8; and the upper edge 89 of the extended portion 81*a* undulates in an irregular manner.

The distal end face 82 defines a closed bottom end for cavity 86 of the applying member 8 and the upper edge 89 of the extended portion 81*a* of the at least one sidewall 81 defines an upper opening of the cavity 86. The distal end face 82 has a consistently continuous convex curve along a width direction, i.e. the distal end face 82 is not flat, but instead protrudes outward in a convex fashion, as seen in FIG. 7.

The cavity 86 at the distal end portion of the applying member 8 is suitable for holding the cosmetic bulk for applying it on a keratinous surface. The cavity 86 has a varying depth that ranges between 0.5 mm-1.5 mm, more particularly between 0.8 mm-1.0 mm.

Figure 7:
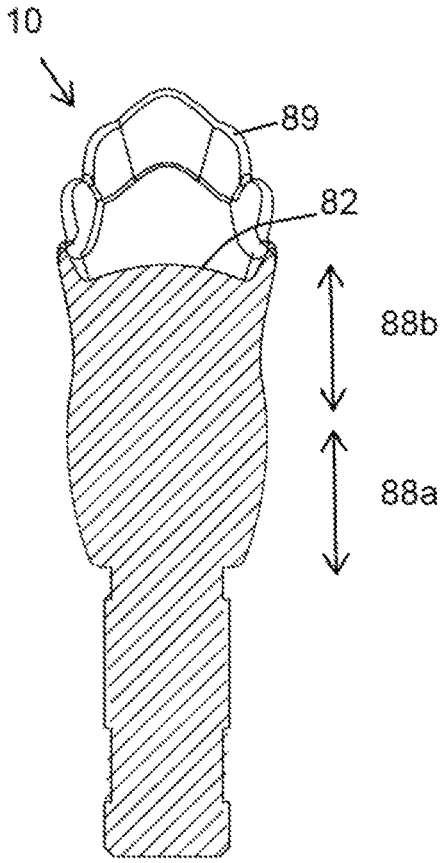
FIG. 7 illustrates a longitudinal cross-sectional view of the applicator head of FIG. 3.

As illustrated in FIG. 7 when the at least one sidewall 81 is viewed from the proximal end 4 towards the distal end 3 of the applying member 8, the at least one sidewall 81 has a convex portion 88*a* followed by a concave portion 88*b*.

The maximum width of the applying member 8 is between 5-8 mm. The minimum width of the applying member 8 is between 4-6 mm.

In a preferred embodiment, at least one sidewall 81 of the applying member 8 has rounded cross-sections that are substantially circular along a major length of the applying member 8. The term "substantially circular" is used herein to describe the circular or nearly circular shape. Particularly, the transverse cross-section of a lower portion of the applying member 8 is circular along the length direction. More particularly, applying member 8 has substantially circular transverse cross-sections when seen towards proximal to the distal end 3 till point P.

The left face 80*c* and the right face 80*d* are symmetrical relative to the plane of symmetry S comprising the longitudinal axis X.

Figure 8:
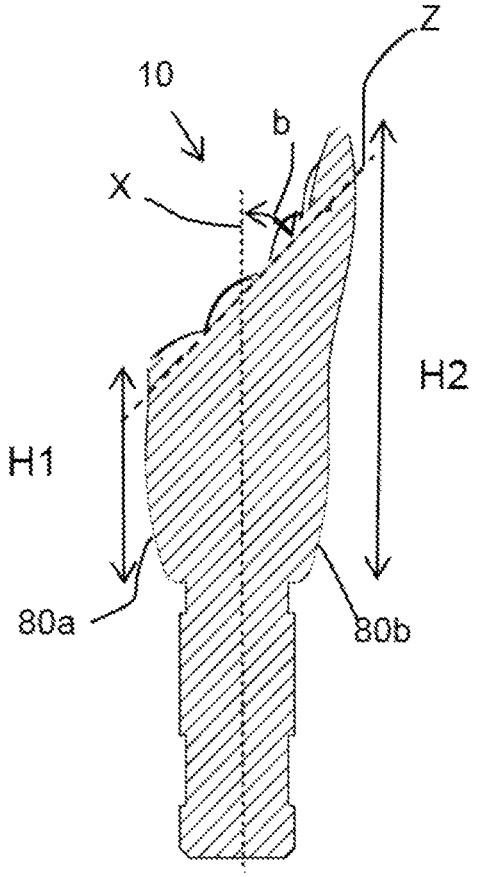
FIG. 8 illustrates another longitudinal cross-sectional view of the applicator head of FIG. 3.

The front face 80*a* has a height less than the height of the rear face 80*b*, as seen in FIGS. 8 and 4. The height of the front face 80*a* is at least 60% of the height of the rear face 80*a*.

Figure 10:
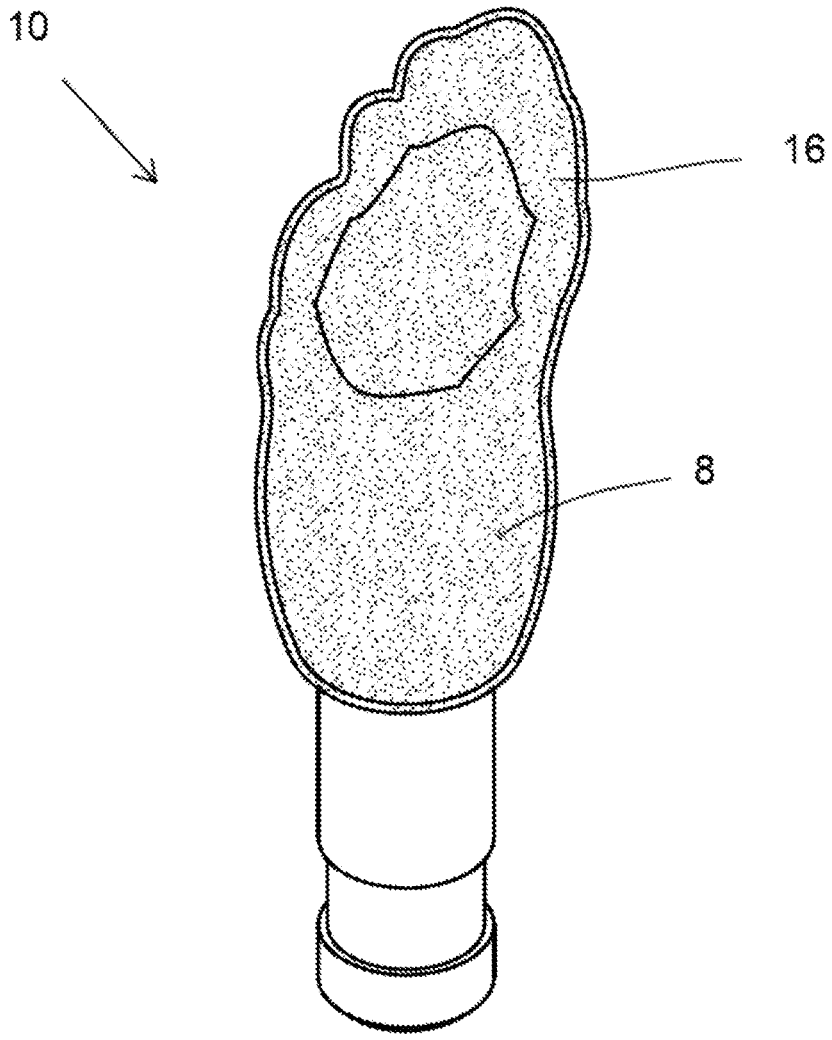
FIG. 10 illustrates a perspective view of the applicator head of FIG. 3 with flocking on an outer surface of an applying member thereof.

FIG. 10 illustrates a perspective view of the applicator head 10 with an outer surface of the applying member 8 flocked with fibers 16. Briefly, the fibers for flocking which may be of any commonly used material, such as nylon, polyester, or any natural fiber are applied with an adhesive, such as an epoxy, to the surface to be flocked. The flocking finish to the outer surface of the applying member 8 may be achieved by an appropriately chosen known technique, such as electrostatic flocking.

According to an alternate embodiment of the present disclosure, the applying member 8 may or may not be flocked or partially flocked.

According to an aspect of the present disclosure, the shank member 7 of the applicator head 10 may be secured to the stem 20, for example, a press-fit, snap-fit, adhesive, and/or engagement by one or more engagement features.

According to an embodiment of the present disclosure, at least a part of the applicator head 10 can be made by molding, e.g. by injection-molding, e.g. in a material selected from the following list: thermoplastic materials; elastomers; thermoplastic elastomers; thermoplastic elastomer polyester such as HYTREL®, for example; nitrile rubber; silicone rubber; ethylene-propylene terpolymer rubber (EPDM); styrene-ethylene-butylene-styrene (SEBS); styrene-isoprene-styrene (SIS); polyurethane (PU); ethyl vinyl acetate (EVA); polyvinyl chloride (PVC); polyethylene (PE); polyethylene terephthalate (PET); polypropylene (PP); this list not being limiting.

In the first embodiment, the wiper 206 serves to wipe off not only the excess cosmetic product attached to the applying member 8 but also the cosmetic product attached to the stem 20.

According to the first embodiment, the receptacle 200 and the cap 30 may be made of a rigid material like glass, metal, hard plastic, or any other material known in the art. However, in alternate embodiments, the receptacle 200 and the cap 30 may be made of a flexible material like flexible polymeric material or any other material known in the art.

According to the first embodiment of the present disclosure, the stem 20 presents a circular cross-section, but it is not beyond the ambit of the present disclosure for this to be otherwise, in particular when the cross-section of the stem 20 is oval, elliptical, or polygonal, e.g. square, triangular or rectangular. The stem 20 can be solid as shown, or, in a variant, it could be hollow.

When the stem 20 is not of circular cross-section, the cap 30 can be fastened on the receptacle 200 by snap-fastening or by some other means, without turning relative to said receptacle 200. The wiper 206 can thus present a non-circular wiper orifice 215 of the section that is complementary to the section of the stem 20.

According to an embodiment of the present disclosure, the applicator head 10 can be made, at least in part, from a material that is more flexible than the material from which the stem 20 is made.

According to the present disclosure, the stem 20 can have a longitudinal axis that is rectilinear as shown. However, in alternate embodiments, it could be curved.

The present disclosure is not limited to, the broadest in accordance with the basic idea disclosed herein. It should be interpreted as having a range. Skilled artisans may implement the pattern of the non-timely manner by combining, replacement of the disclosed embodiments shape, this would also do not depart from the scope of the disclosure. In addition, those skilled in the art may readily change or modifications to the disclosed embodiments, based on the present specification, such changes or modifications also belong to the scope of the present disclosure will be apparent.

The invention claimed is:

1. An applicator head for applying a cosmetic or a care product, the applicator head comprises:

an applying member elongated along a longitudinal axis;

wherein the applying member includes a distal end face and at least one sidewall extending from a proximal end of the applying member to a distal end of the applying member;

wherein the at least one sidewall defines a front face, a rear face, a left face, and a right face of the applying member;

wherein the at least one sidewall of the applying member includes an extended portion that extends beyond the distal end face of the applying member and defines the distal end of the applying member;

wherein the extended portion of the at least one sidewall peripherally encloses the distal end face of the applying member to define a cavity at a distal end portion of the applying member;

wherein the cavity opens upwardly and has a closed bottom end that is defined by the distal end face of the applying member;

wherein the extended portion includes multiple petals that surround the distal end face;

wherein lateral edges of each petal is joined to lateral edges of the adjacent petals such that there are no circumferential gaps or slots between the adjacent petals;

wherein the distal end face is inclined with respect to the longitudinal axis of the applying member;

wherein a distal-most petal is located at an upper peripheral edge of the distal end face and a proximal-most petal is located at a lower peripheral edge of the distal end face; and, wherein an apex of the distal-most petal defines the distal end of the applying member.

2. The applicator head according to claim 1, wherein the distal end face makes an acute angle with the longitudinal axis of the applying member and wherein the acute angle is in the range between 30° and 75°.

3. The applicator head according to claim 1, wherein the distal end face extends between 20%-40% of the length of the applying member; wherein the distal end face is inclined towards the front face; and wherein the distal end face has a consistently continuous convex curve along a width direction.

4. The applicator head according to claim 1, wherein the extended portion of the at least one sidewall has multiple grooves on its outer surface facing the cavity; wherein each groove substantially extends along a length direction of the petal; wherein each groove extend between the adjacent petals and define at least one common lateral edge between the adjacent petals; and wherein the multiple grooves are made in the thickness of the extended portion without causing any fragmentation in the extended portion.

5. The applicator head according to claim 4, wherein at least a few grooves of the extended portion, that are located near the distal end of the extended portion, extend onto an upper edge of the extended portion and onto the rear face of the applying member; and wherein the grooves that extend on the rear face converge and meet at a point on the rear face.

6. The applicator head according to claim 5, wherein the distal end portion on the rear face, where the grooves extend, is convexly curved both in width and length direction thereof, and wherein because the presence of the grooves on the distal end portion of the rear face, the rear face forms finger like protruded surfaces.

7. The applicator head according to claim 1, wherein an outer surface of the applying member is at least partially flocked with fibers.

8. The applicator head according to claim 1, wherein the left face and the right face are symmetrical relative to a plane of symmetry comprising the longitudinal axis of the applying member.

9. The applicator head according to claim 1, wherein each of the multiple petals has a length that forms at most about one-fourth of the total length of the applying member; wherein the length of the distal end face, measured along the longitudinal axis of the distal end face, is at least three times the length of each of the multiple petals; wherein the length of the distal end face is between 5-8 mm; wherein the width of the distal end face, measured perpendicularly to the longitudinal axis of the distal end face, is between 4-6 mm.

10. The applicator head according to claim 1, wherein the extended portion comprises eight petals that surrounds the cavity at the distal end portion of the applying member; wherein at least one of the eight petals, the distal-most petal, is located at a distal-most portion of the applying member; wherein the proximal-most petal, is located at a lower peripheral edge of the distal end face; wherein there are three petals arranged at a peripheral right edge of the distal end face between the distal-most petal and the proximal-most petal; and wherein three petals are located along a peripheral left edge of the distal end face arranged between the distal-most petal and the proximal-most petal.

11. The applicator head according to claim 1, wherein a plane of symmetry of the applying member passes through the distal-most petal and the proximal-most petal; wherein the proximal-most petal is widest of the all the petals and the proximal-most petal has two apexes; and wherein the distal-most petal is the longest of all the multiple petals.

12. The applicator head according to claim 1, wherein at least two petals have the same shape and at least two petals have different shapes from each other; and wherein at least two petals differ on at least one of their shape and size.

13. The applicator head according to claim 1, wherein at least one of the multiple petals has a maximum width between 3.5-7 mm and at least one other petal has a maximum width between 1.5-2.5 mm; wherein the length of the petals may range between 0.5-3 mm; and wherein the thickness of the petals may range from 0.5-1.5 mm.

14. The applicator head according to claim 1, wherein the at least one sidewall of the applying member is viewed from the proximal end towards the distal end of the applying member, the at least one sidewall has a convex portion followed by a concave portion.

15. The applicator head according to claim 1, wherein a maximum width of the applying member is between 5-8 mm and a minimum width of the applying member is between 3-6 mm.

16. The applicator head according to claim 1, wherein the cavity at the distal end portion of the applying member is suitable for holding a cosmetic product for applying it on a keratinous surface; wherein the cavity has a varying depth that ranges between 0.5 mm-1.5 mm.

17. The applicator head according to claim 1, wherein the applicator head is incorporated in a cosmetic package; wherein the cosmetic package comprises a receptacle for holding a product and a cosmetic applicator; wherein the cosmetic applicator comprises the applicator head, a stem, and a cap; and wherein the applicator head is retained at a distal end of the stem for applying the product and the cap at a proximal end of the stem.

18. An applicator head for applying a cosmetic or a care product, the applicator head comprises:

an applying member elongated along a longitudinal axis;

wherein the applying member includes a distal end face and at least one sidewall extending from a proximal end of the applying member to a distal end of the applying member;

wherein the at least one sidewall of the applying member includes an extended portion that extends beyond the distal end face of the applying member;

wherein the extended portion of the at least one sidewall peripherally encloses the distal end face of the applying member to define a cavity at a distal end portion of the applying member;

wherein the cavity opens upwardly and has a closed bottom end that is defined by the distal end face of the applying member;

wherein the extended portion includes multiple petals that surround the distal end face;

wherein each petal is laterally joined to the adjacent petals such that there are no circumferential gaps or slots between the adjacent petals;

wherein an upper edge of the extended portion is a continuous surface extending in a circumferential direction and is inclined with respect to the longitudinal axis of the applying member;

wherein the upper edge of the extended portion undulates in an irregular manner.

19. An applicator head for applying a cosmetic or a care product, the applicator head comprises:

an applying member elongated along a longitudinal axis;

wherein the applying member includes a distal end face and at least one sidewall extending from a proximal end of the applying member to a distal end of the applying member;

wherein the at least one sidewall of the applying member includes an extended portion that extends beyond the distal end face of the applying member;

wherein the extended portion of the at least one sidewall peripherally encloses the distal end face of the applying member to define a cavity at a distal end portion of the applying member;

wherein the cavity opens upwardly and an upper edge of the extended sidewall defines an opening of the cavity;

wherein the cavity has a closed bottom end that is defined by the distal end face of the applying member;

wherein the extended portion includes multiple petals that surround the distal end face;

wherein each petal is joined to the adjacent petals such that each of the multiple petals share a common lateral edge with an adjacent petal; and wherein the distal end face is inclined with respect to the longitudinal axis of the applying member.

20. The applicator head according to claim 19, wherein the extended portion of the at least one sidewall has multiple grooves on its outer surface facing the cavity; wherein each groove substantially extends along a length direction of the petal; wherein each groove extend between the adjacent petals and define at least one common lateral edge between the adjacent petals; and wherein the multiple grooves are made in the thickness of the extended portion without causing any fragmentation in the extended portion.

* * * * *